US008040665B2

(12) United States Patent
Thrue

(10) Patent No.: US 8,040,665 B2
(45) Date of Patent: Oct. 18, 2011

(54) MODULAR COMPACT SECONDARY SUBSTATION

(75) Inventor: Carsten Thrue, Braedstrup (DK)

(73) Assignee: ABB Technology AG, Zurich (CH)

( * ) Notice: Subject to any disclaimer, the term of this patent is extended or adjusted under 35 U.S.C. 154(b) by 856 days.

(21) Appl. No.: 12/048,086

(22) Filed: Mar. 13, 2008

(65) Prior Publication Data

US 2008/0222971 A1 Sep. 18, 2008

(30) Foreign Application Priority Data

Mar. 16, 2007 (EP) ..... 07104349

(51) Int. Cl.
*H02B 1/00* (2006.01)
*E04H 1/12* (2006.01)
*H05K 7/20* (2006.01)

(52) U.S. Cl. ..... 361/678; 361/601; 361/676; 52/18; 52/79.1; 52/79.9; 454/184

(58) Field of Classification Search ..... 361/601–602, 361/676–678; 52/79.1, 79.9, 90.1, 18, 79.12, 52/561, 800.12; 220/4.02–4.03, 4.26–4.27; 454/184
See application file for complete search history.

(56) References Cited

U.S. PATENT DOCUMENTS

| | | | | | |
|---|---|---|---|---|---|
| 414,976 | A * | 11/1889 | Harvey | 52/69 |
| 3,184,012 | A * | 5/1965 | Ishimoto et al. | 52/93.1 |
| 3,253,371 | A * | 5/1966 | Honold et al. | 52/86 |
| 3,587,908 | A | 6/1971 | Nickel | |
| 3,832,605 | A | 8/1974 | Clark, Jr. | |
| 4,050,605 | A * | 9/1977 | Wakana et al. | 220/565 |
| 4,187,651 | A * | 2/1980 | Tolsma | 52/79.1 |
| 5,191,742 | A * | 3/1993 | Romig et al. | 52/79.9 |
| 5,425,207 | A * | 6/1995 | Shayman | 52/79.9 |
| 5,904,006 | A * | 5/1999 | Evans | 52/81.4 |
| 6,098,350 | A * | 8/2000 | Kochtitzky | 52/136 |
| 6,250,022 | B1 * | 6/2001 | Paz et al. | 52/79.5 |
| 6,311,858 | B1 * | 11/2001 | Csiszar | 220/4.03 |
| 6,415,558 | B1 * | 7/2002 | Cherry | 52/79.1 |
| 6,598,363 | B1 * | 7/2003 | Ferguson et al. | 52/272 |
| 6,601,598 | B2 * | 8/2003 | Clee et al. | 135/143 |
| 2009/0145051 | A1 * | 6/2009 | Andrei | 52/79.1 |

FOREIGN PATENT DOCUMENTS

| | | |
|---|---|---|
| FR | 1 140 017 A | 7/1957 |
| FR | 2 762 029 A1 | 10/1998 |

OTHER PUBLICATIONS

European Search Report dated Jul. 30, 2007.

* cited by examiner

*Primary Examiner* — Robert J Hoffberg

(74) *Attorney, Agent, or Firm* — Buchanan Ingersoll & Rooney PC

(57) ABSTRACT

An electricity transformer station having a foundation and a housing on top of the foundation, the housing comprising walls and a roof. The housing comprises a plurality of identical modules assembled in a row along a longitudinal axis of the housing, each of the modules having two side walls and a roof section connecting the side walls.

20 Claims, 12 Drawing Sheets

Front view

MODULAR COMPACT SECONDARY SUBSTATION

RELATED APPLICATION

This application claims priority under 35 U.S.C. §119 to European Patent Application No. 07104349.1 filed in the European Patent Office on 16 Mar. 2007, the entire content of which is hereby incorporated by reference in its entirety.

TECHNICAL FIELD

The present disclosure relates to the construction of buildings for trans-former stations, such as compact secondary substations.

BACKGROUND INFORMATION

The term Compact Secondary Substation (CSS) is typically used for trans-former stations in which the power from the main electricity net is transformed from medium voltage, which is in the range 12-24 kV, to low voltage, which is in the range of 100-1000 volts. Typical CSS are produced with a concrete foundation and a concrete or metal housing on top of the foundation. Examples of typical prior art CSS are shown in FIG. 1*a* and FIG. 1*b*. Prior art CSS systems are to a certain degree modular in as much as part of the walls of the CSS may be extended by metal profiles to the desired length of a station. When the correct configuration has been achieved, a roof is placed on top of the walls, where the roof is assembled of typically two modules or made in one piece, if the station is of relatively small dimensions.

The modular wall concept implies a certain degree of flexibility, because lengths of CSS can be varied by similar wall sections and adapted to the length of the foundation, which, normally, comes in few certain predetermined model lengths. An assembly, where the length can be freely chosen is not possible, because the roofs are only delivered in certain lengths and because part of the side walls along the foundations does not follow the modular metal profiles with respect to partition.

However, in line with the increasing demands for different types of CSS in different countries, there is an aim for even greater flexibility when it comes to CSS construction.

SUMMARY

It is therefore the object of the disclosure to provide a CSS design with a greater construction flexibility. An electricity transformer station is disclosed, having a foundation and a housing, for example made of metal, on top of the foundation. The housing comprises a plurality of identical modules assembled in a row along a longitudinal axis of the housing, each of the modules having two side walls and a roof section connecting the side walls.

BRIEF DESCRIPTION OF THE DRAWINGS

The disclosure will be explained in more detail with reference to the drawing, where.

DETAILED DESCRIPTION

Figure 1A:
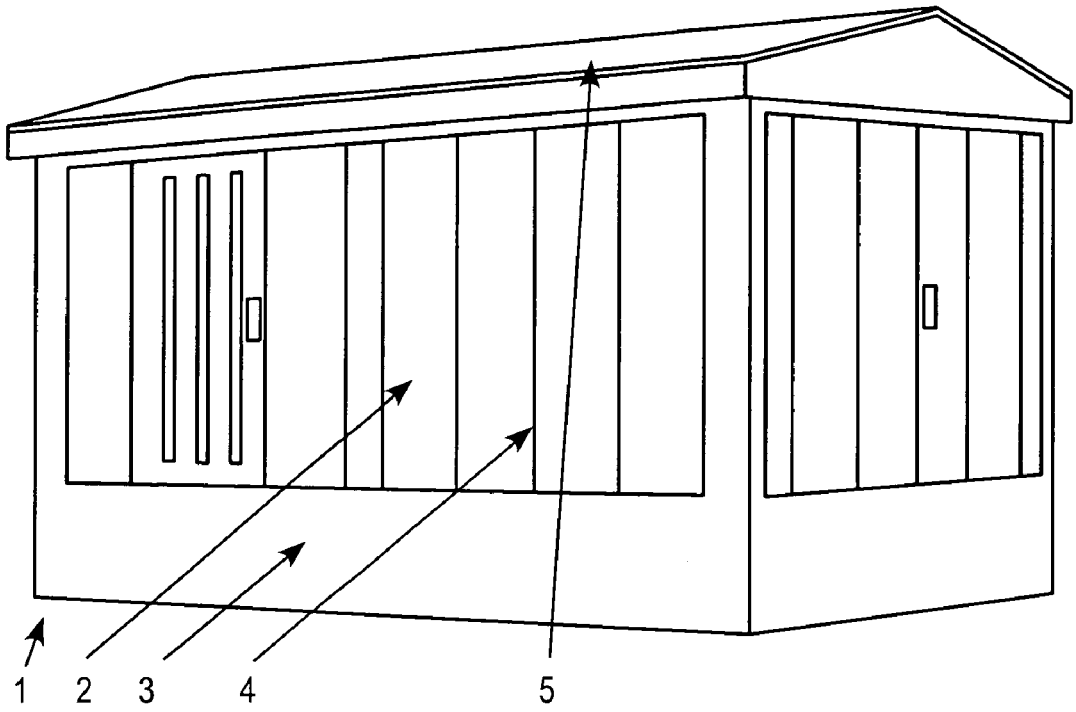
PRIOR ART FIG. 1a
FIGS. 1 *a*) and *b*) illustrate prior art CSS.

As the housing/building according to the disclosure comprises a number of identical modules forming slices lengthwise of the housing construction, there is a great flexibility with respect to the size of the station according to the disclosure, primarily an electricity transformer station, for example a CSS. In dependence of the desired length, an appropriate number of modules is selected and assembled. By providing series of modules with different sizes, not only the length can be varied accordingly, but for smaller or larger transformer stations or CSS housings, a different series of modules may be selected.

For the producer, it is of great advantage that for a certain width of stations only one type of modules has to be produced for stations of different lengths. For example, there may be a demand in the market for stations with five different lengths. By using a single type of modules, the producer may provide such five types of stations without the necessity of producing five entirely different units for the different housings. Also, the producer can produce one type of modules in large quantities, which reduces the costs for a station, and assemble these module on demand, which reduces the risk for overproduction of certain types of housing units.

A simplification, which is of great advantage for the producer, is a further embodiment where the modules are configured with complementary flanges with holes such that they may be fastened to each other by means of a single type of screws or rivets, where all screws or rivets have the same dimension.

For example, the modules may have roughly identical assembly flanges on both ends of the side walls for mutual assembly. In a certain embodiment, the flanges are interconnected by means of a U-formed profile with a first leg and a second leg forming the U-form, wherein the first leg is connected to a first module and the second leg is connected to a second module.

The side walls and the roof section can be provided as similar shaped profiles. For example, the similar shaped profiles have a cross section comprising:

- a straight part forming the side wall and the roof section;
- a V shaped profile extending from one end of the straight part with a sharp angle w between the V-shaped section and the straight part, the V-shaped profile ending in a first L-formed profile,
- a second L-formed profile extending from an opposite end of the straight part.

An exemplary module according to the disclosure has two vertical side walls and a roof section connecting the side walls, wherein the surface of the side walls and the roof section have an angle v larger than zero, for example between 10° and 45°, between the side wall and the longitudinal axis of the station. The longitudinal axis of the station extends between the front and the back of the station. The side walls may be substantially plane sheets. Alternatively, the side walls may be bending.

For access to the station, it may comprise a door part with an access door and a surrounding door frame, the door frame being mounted to the end of the assembled plurality of modules.

In an exemplary embodiment, the module for a station according to the disclosure has a first flange section with a first flange for connection with a first further module and has a second flange section with a second flange for connection with a second further module. The side walls and the roof section connect the first flange section and the second flange section, wherein the first flange section has larger outer dimensions than the second flange section due to the side walls and the roof section being non-parallel with the longitudinal axis of the station. In addition, the first flange section may have an upper wall part connecting the roof with the first flange, the upper wall part, optionally, having openings for ventilation. Such ventilation may be configured primarily as air flow exits. Air flow inlets can be provided in or near the bottom of the housing in order to provide an efficiently cooling air flow. In this connection, it should be remembered that the transformer in the housing produces heat. For provision of air inlets, in a further embodiment, the module has a bottom wall extending a distance inwards from the side wall, the bottom wall being provided with openings for ventilation. In a specific embodiment, the ratio between inlet opening and outlet opening cross section area is app. 4:5, which has proven optimum in practical tests.

Though the modules may be produced of fibre reinforced polymers or concrete, the preferred material is metal sheets for the wall and roof of the modules. These metal sheets may be welded together, through other assembly forms are possible, for example screwing.

The station according to the disclosure can be an electricity transformer station, but the disclosure may be used in other types of housings for technical equipment as well.

Figure 1B:
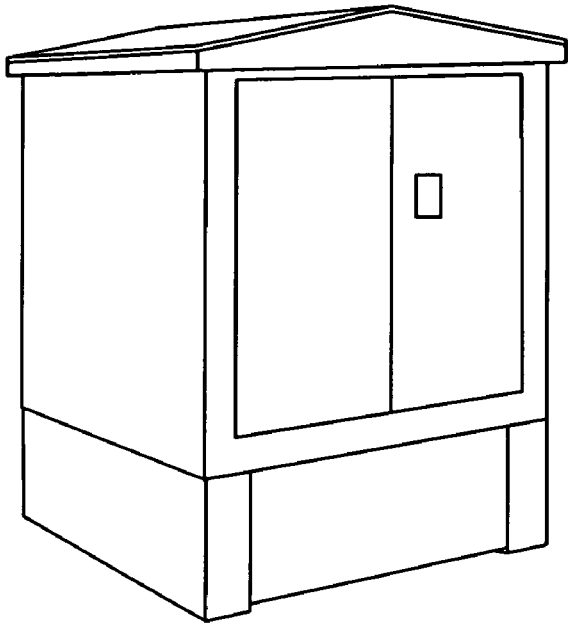
PRIOR ART FIG. 1b

FIG. 1*a* and FIG. 1*b* illustrate prior art CSS. In FIG. 1*a*, a CSS 1 is illustrated, where the side walls are made up of modular sheets 2 resting on a lower wall part 3 which covers the foundation and which is not made of modules following the assembly edges 4 of the wall modules 2. The roof 5 of the CSS 1 is made in one piece, which limits the flexibility with regard to the design of the length of the CSS 1. The CSS in FIG. 1*b* is made with side walls that are not modular, reducing the degree of flexibility.

FIG. 2 illustrates an exemplary embodiment according to the disclosure in *a*) a front view, *b*) a top view, *c*) a side view, *d*) a back view, *e*) a perspective view. As shown in FIG. 2*b*, the CSS according to the present disclosure comprises a plurality of identical modules 10 with side walls 11 that have an angle v with the longitudinal axis 12 of the CSS, i.e. an axis extending from the front face 100 to the back face 200 of the CSS. These modules form a housing which is suitable to host an electrical transformer and possibly other various electrical equipments and is usually mounted on a foundation, schematically represented only in FIG. 2*e* with the reference numeral 300.

The side walls 11 are plane and extend from a first flange section 13 with a first flange to a second flange section 15. The side walls 11 and the roof section 17 connect the first flange section 13 and the second flange section 15. As indicated in the top view in FIG. 2*b*, the first flange section 13 has outer dimensions d2 that are larger than the outer dimensions d1 of second flange section 15 due to the side walls 11 and the roof section 17 being non-parallel with the longitudinal axis 12 of the station 1.

The side walls 11 and the roof section 17 can be made of similar profiles. For example, these profiles can be substantially identical, which is also shown in FIG. 2. Such a profile is illustrated in a cross sectional view in FIG. 7 for both the roof section 17 and for a side wall 11. The cross section is horizontal for the side wall and vertical for the roof section. As shown, the profile comprises a first flange section 13 with first 13*a*, second 13*b* and third 13*c* straight sections and a flange 14 for connection with a further module. The first 13*a* and the second 13*b* straight sections form a V-shaped profile having a sharp angle w with the straight wall part 111 (or roof section 117). The third straight section 13*c* and the flange 14 form a first L shaped, inward oriented profile. The second flange section 15 comprises a fourth straight section 15*a* and a flange 16, together forming a second L-shaped profile oriented inwards. The side wall—or, likewise, the roof—extend between the V-shaped FIG. 13*a*, 13*b* of the first flange section 13 and the L formed profile 15*a*, 16 of the second flange section 15. In addition, the side wall 11 or roof section 17 has an inclination angle v as measured from the longitudinal axis 12 of the station. As indicated in FIG. 2*c*, the roof, also, has an angle v with the longitudinal axis 12 of the station.

Figure 3A:
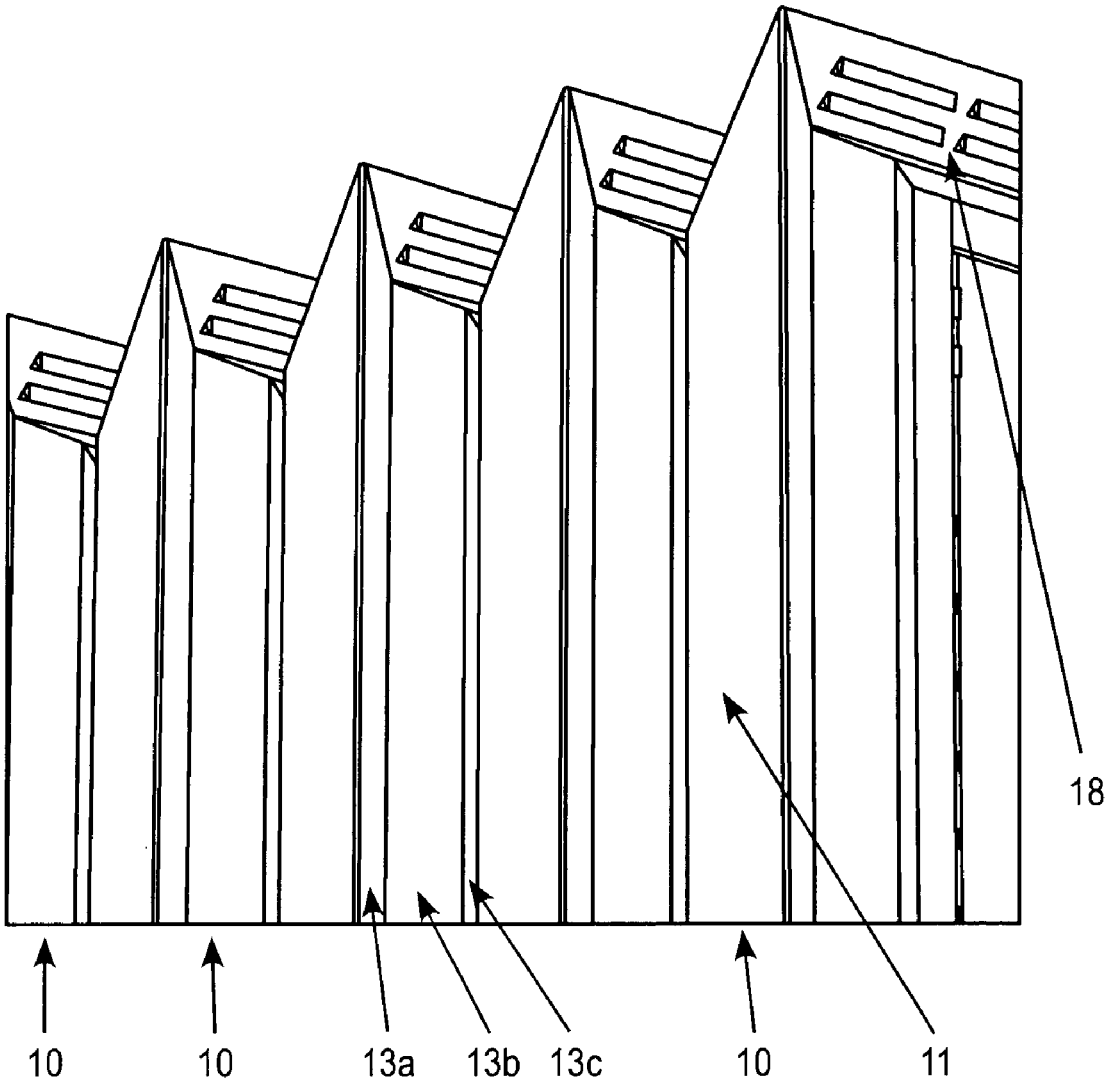
FIG. 3 *a*) illustrates part of a side wall of a CSS according to the disclosure seen in a direction under an angle; *b*) illustrates an enlarged section of FIG. 3*a*, showing the upper wall part with air outlet openings.
Figure 3B:
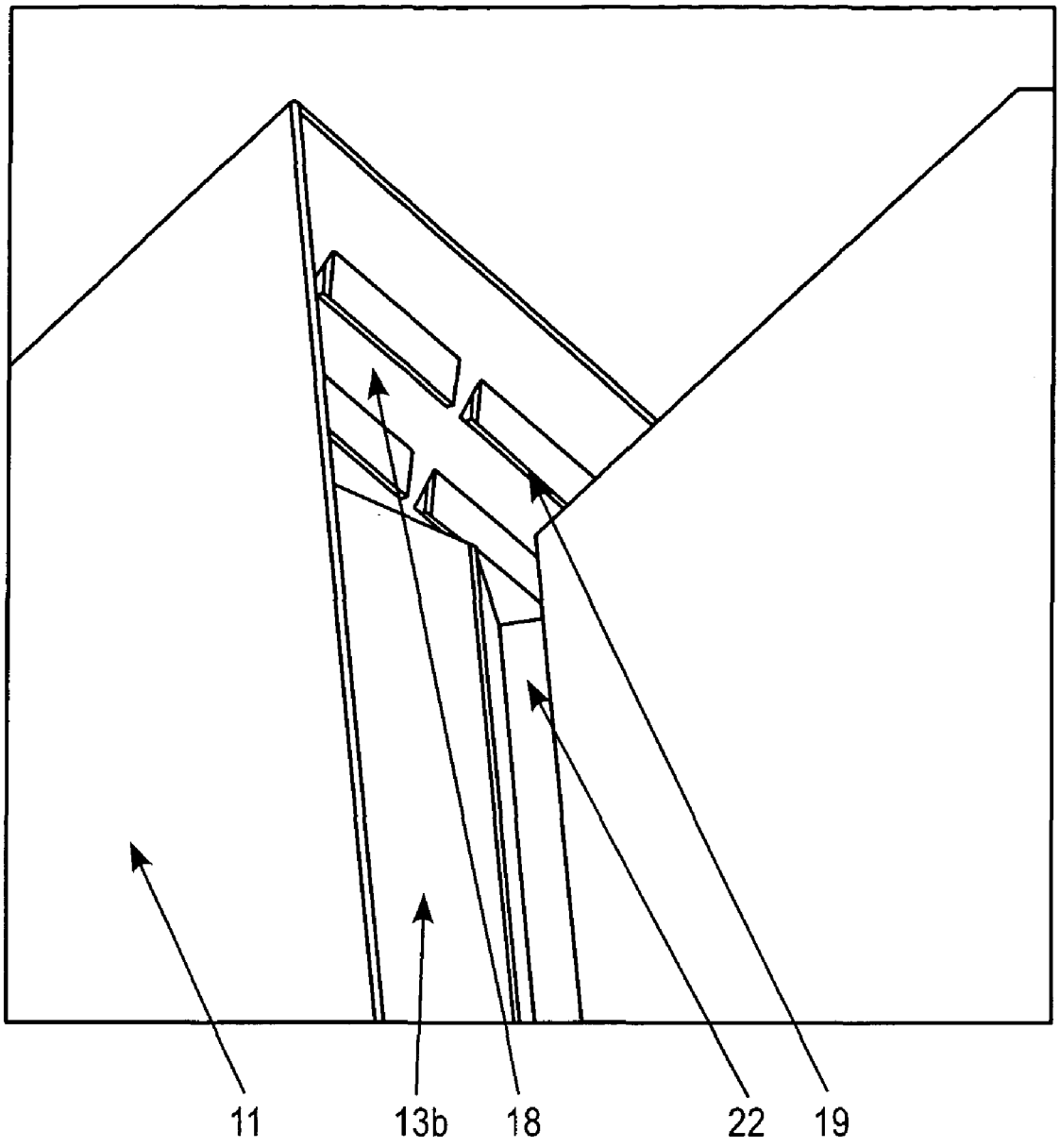

As illustrated in FIG. 3*a* and FIG. 3*b*, which is an enlarged view of a part of FIG. 3*a*, the first flange section 13 has an upper wall part 18—being largely similar to the straight section 13*a* of the side wall—the upper wall part 18 connecting the roof section 17 with the first flange 14 (not shown in FIG. 3*a*). This upper wall part 18 has openings 19 for ventilation.

Figure 4:
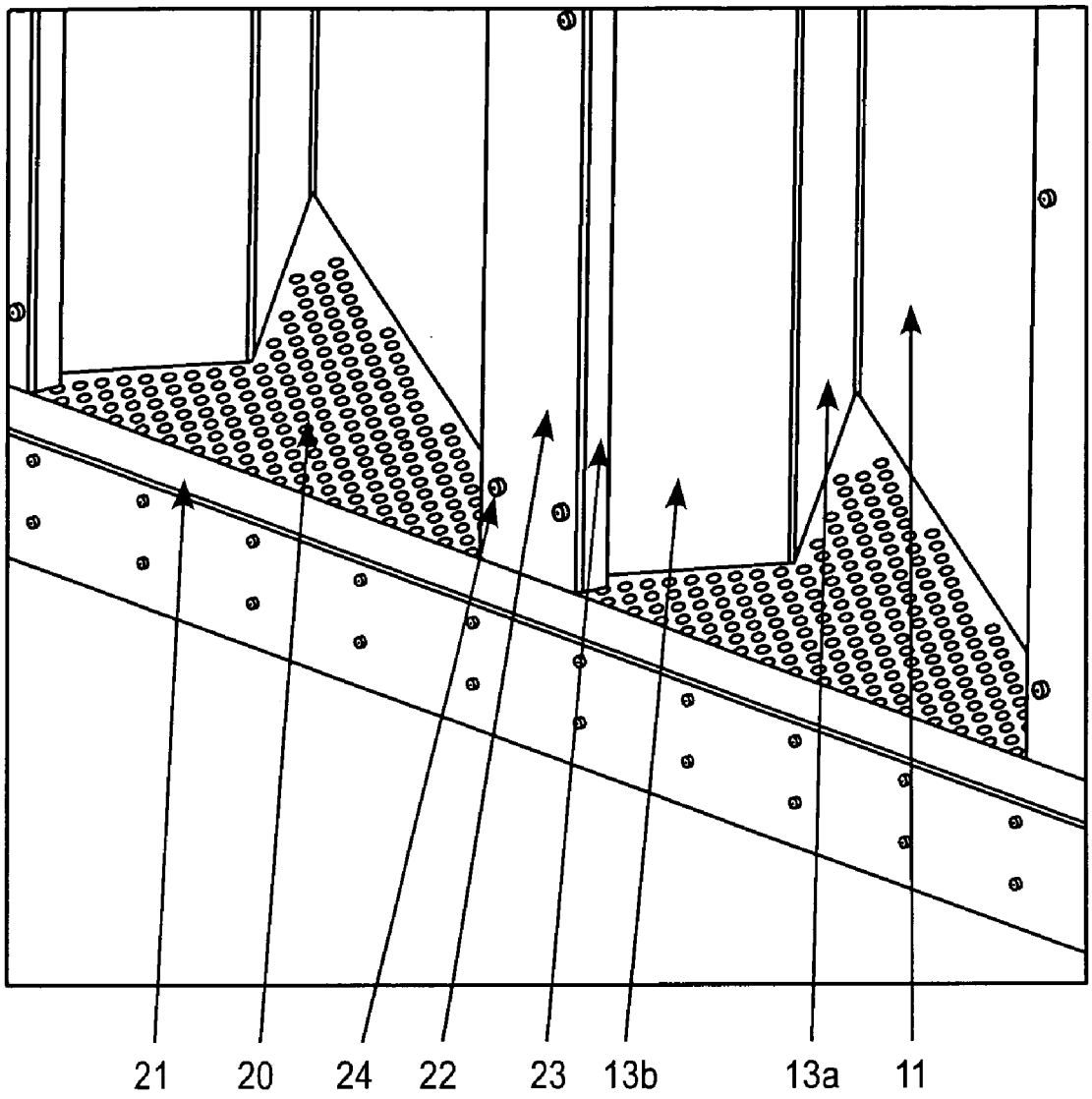
FIG. 4 is a view of a bottom wall with air inlet openings.
Figure 7:
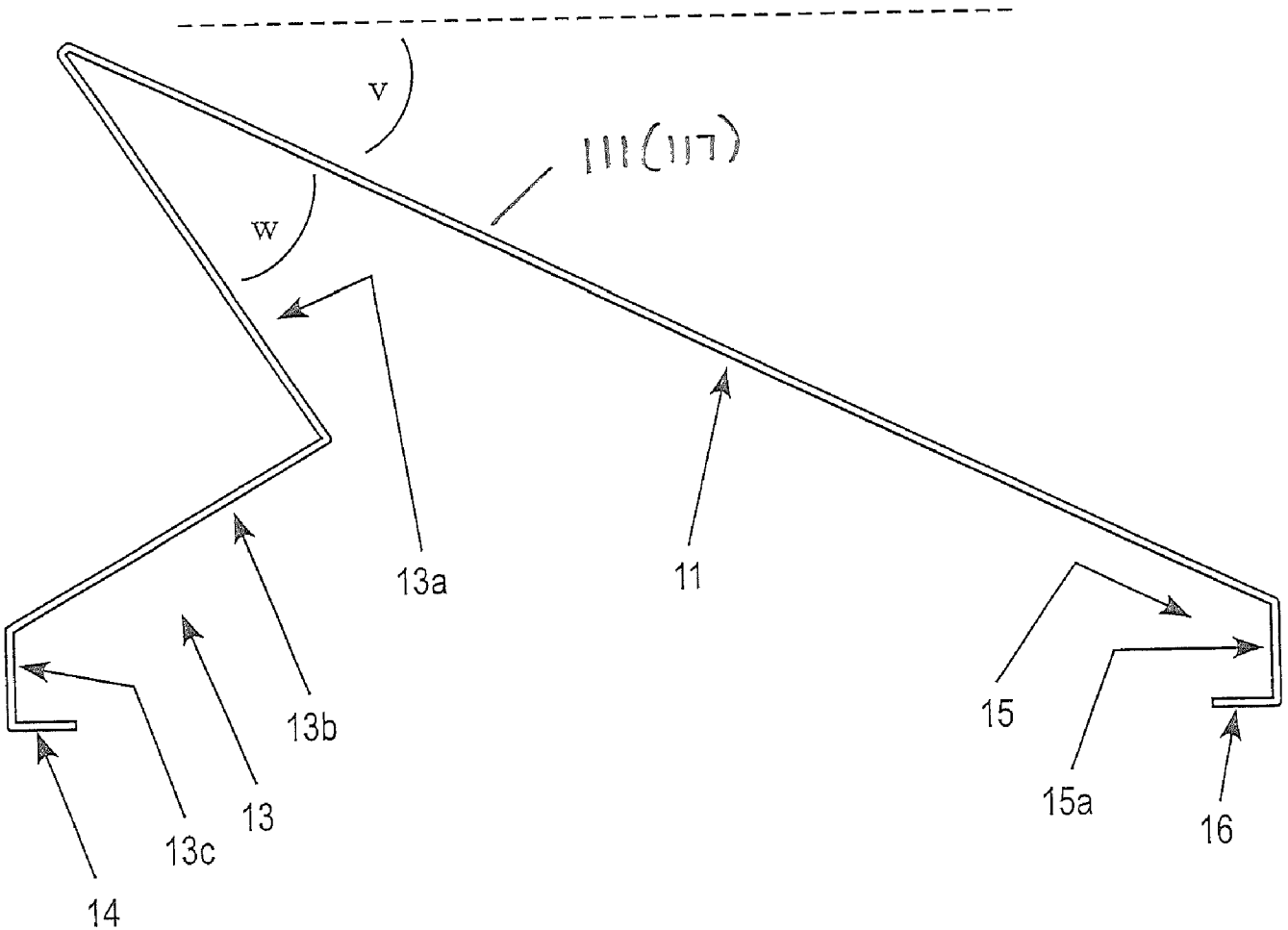
FIG. 7 is a schematic view illustrating the cross section of a side wall or roof section of the module.

These openings 19 act as air flow outlets due to the heat produced in the CSS. As air inlets, there are provided further openings 20 in bottom wall parts 21 as illustrated in FIG. 4 which shows a drawing of the inner side of the walls 11 and the first flange 13 including the first straight section 13*a*, the second straight section 13*b* and the third straight section 13*c*. The first flange 14 and the second flange 16 are assembled by means of a U-formed profile 22 with a first leg 23 and a second leg (which is not visible in the drawings and is parallel to the first leg 23) forming the U-form. This U-formed profile 22 is fastened to the flanges 14 and 16 by means of screws 24, as illustrated in FIG. 4. In particular, when assembled, the U-shaped profile 22 covers the first L shaped profile—formed by the third straight section 13*c* and the flange 14—and the second L-shaped profile—formed by the straight section 15*a* and the second flange 16—as illustrated in FIG. 7 and explained in more detail above. The mounting of the U-formed profile results in the profile being visible as a vertical bar from the outside, as illustrated in FIG. 3*b*. This visible part of the U-formed profile can be provided with a special reflective, coloured surface relatively to the rest of the CSS walls in order to increase the safety, in as much as it makes the CSS easier to recognise as a building when illuminated by cars at night.

Figure 5A:
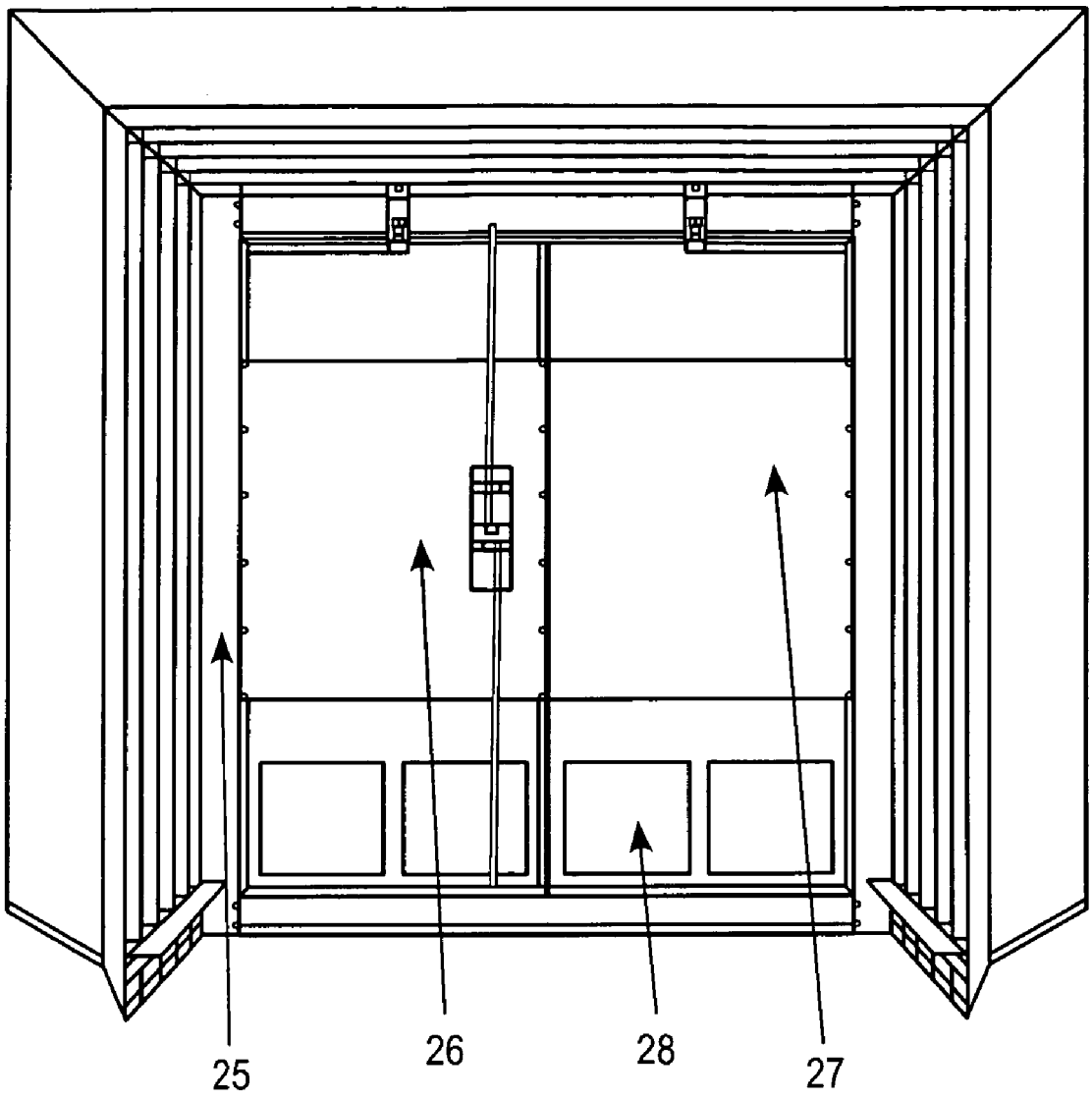
FIG. 5 *a*) is a view of the inner space of a CSS with a door frame at the end of the CSS; *b*) is a close up view of the inner side of the door in the door frame shown in FIG. 5*a;*
Figure 5B:
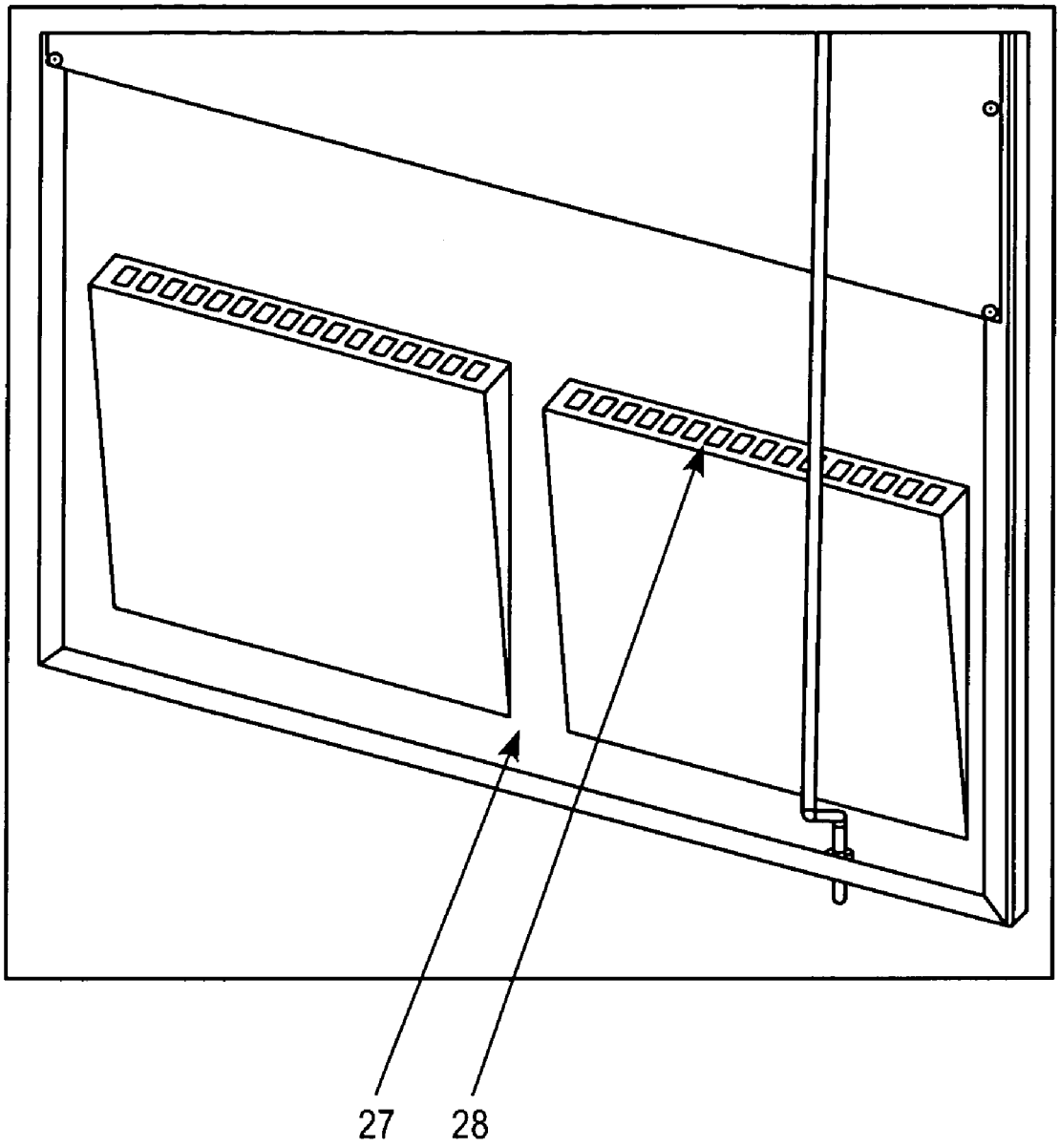

One end of the CSS is shown in a drawing in FIG. 5*a* of the inside the CSS with a view in a direction towards the door assembly 25. The door assembly 25 comprises a first door 26 and a second door 27, where each of the doors 26 and 27 is provided with ventilation opening 28, shown in greater detail in FIG. 5*b*. Of the two doors, a main door 26 includes a handle and lock and a blind door 27 only opens after the main door 26 has been opened. The door handle is hidden from the door surface by using a boxed design that also allows a number of different locks to apply. For locking purposes, door locking pins may be mounted in the main door, intruding to the top and bottom profiles when locking.

Figure 2A:
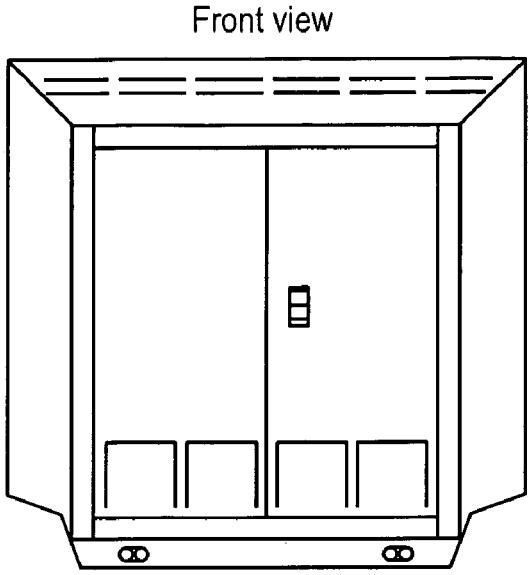
FIG. 2 illustrates an exemplary embodiment according to the disclosure in *a*) a front view, *b*) a top view, *c*) a side view, *d*) a back view, *e*) a perspective view.
Figure 2B:
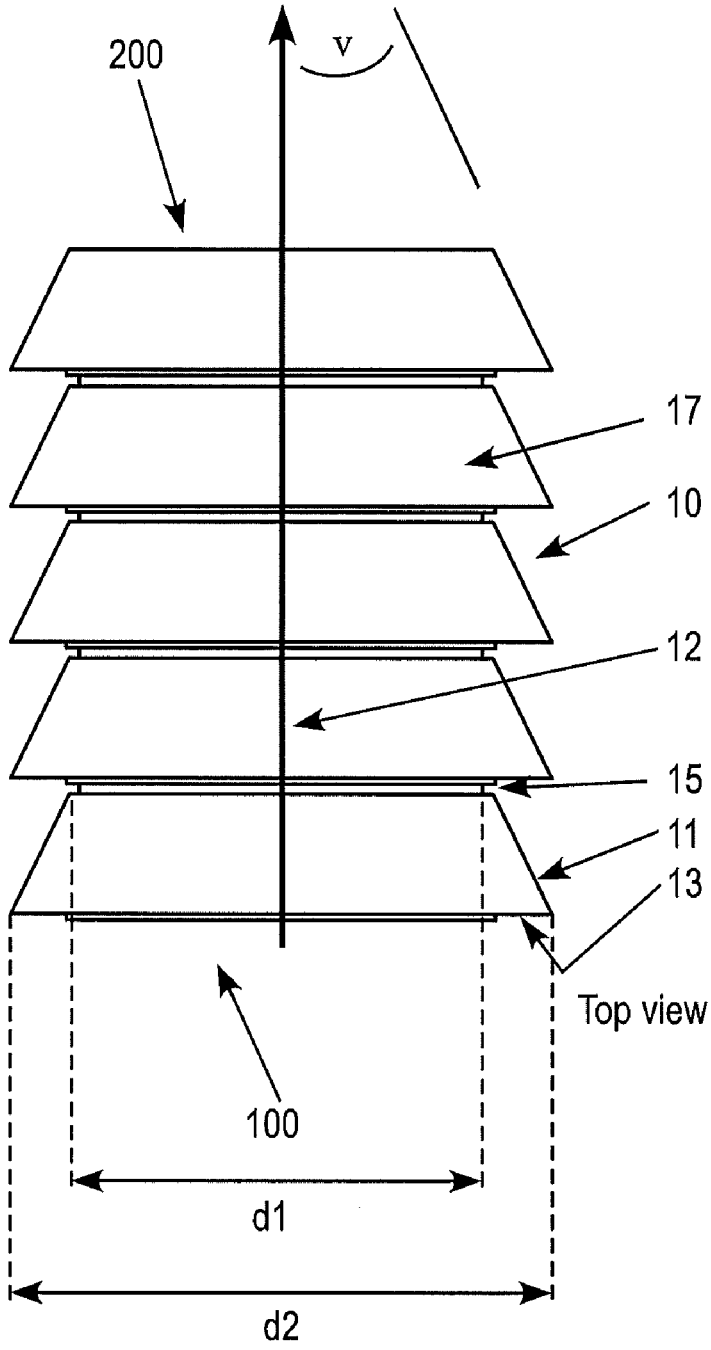
Figure 2C:
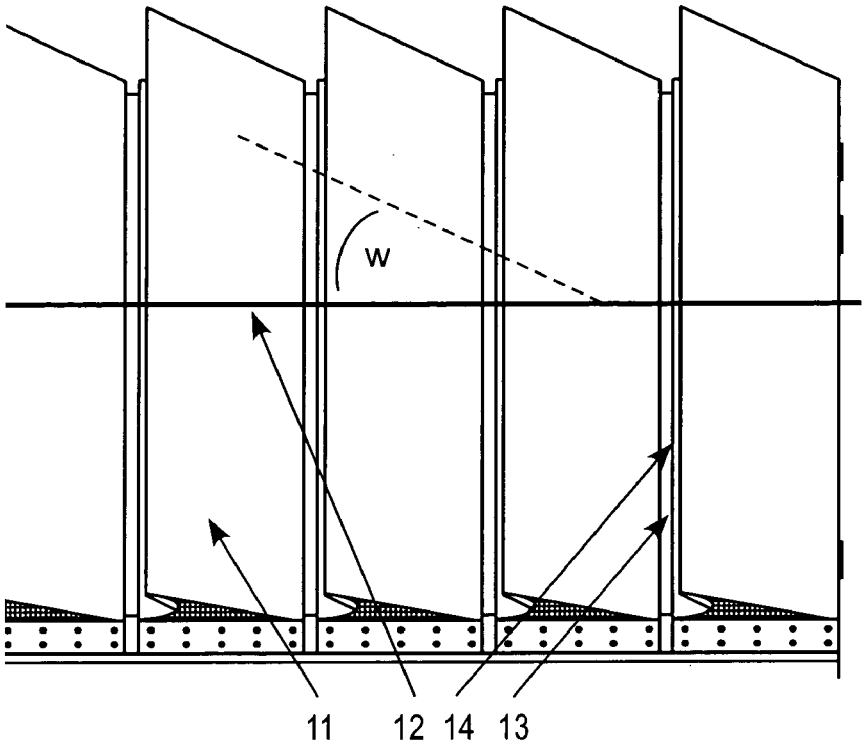
Figure 2D:
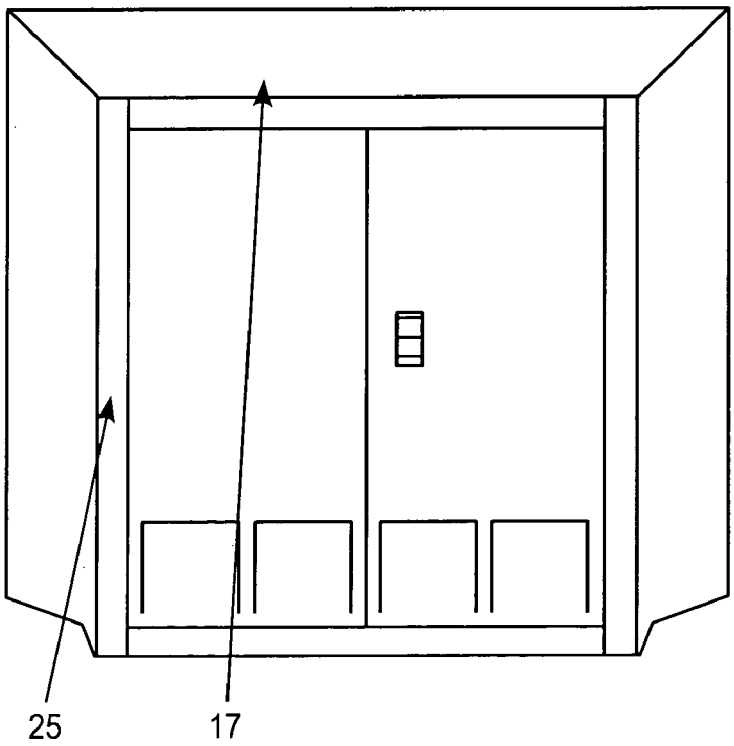
Figure 2E:
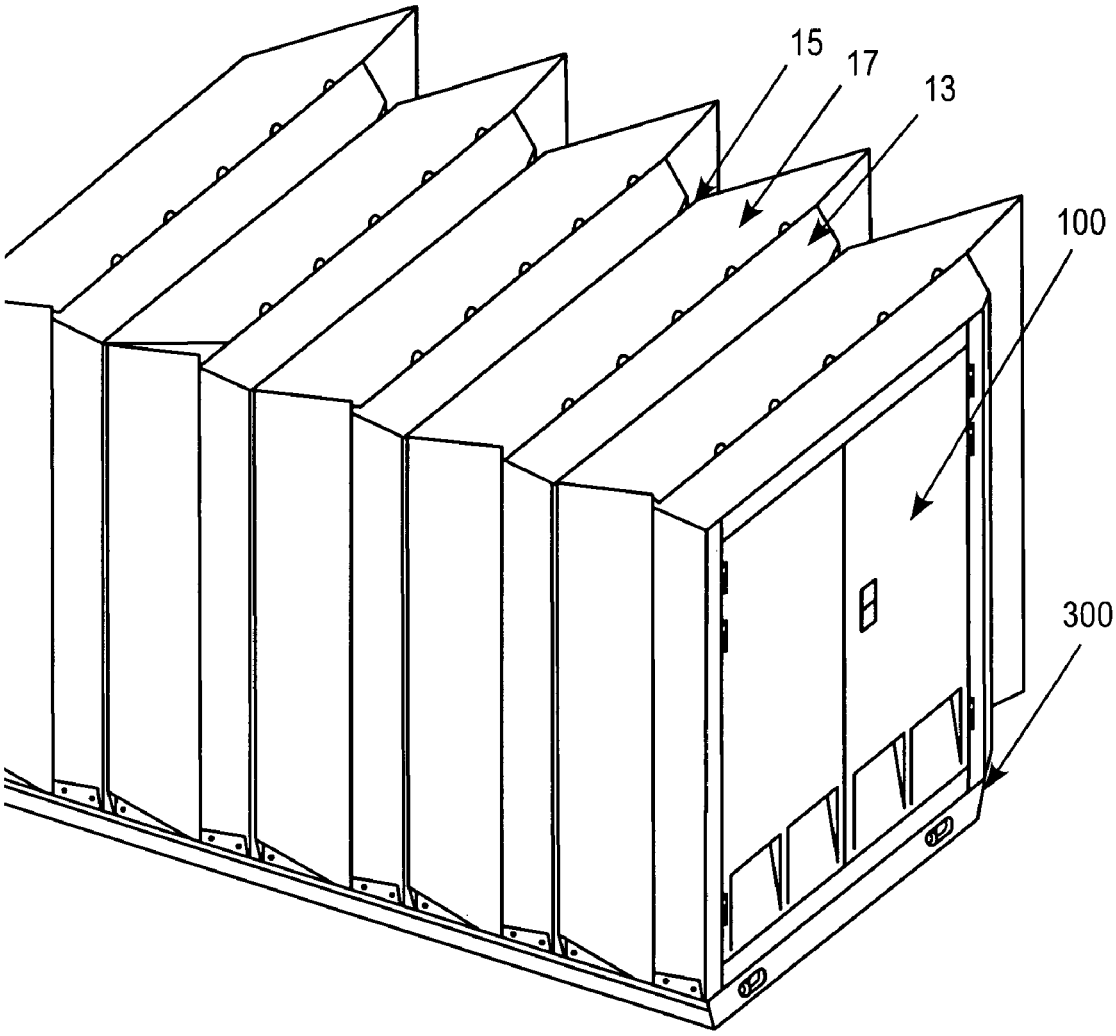
Figure 6:
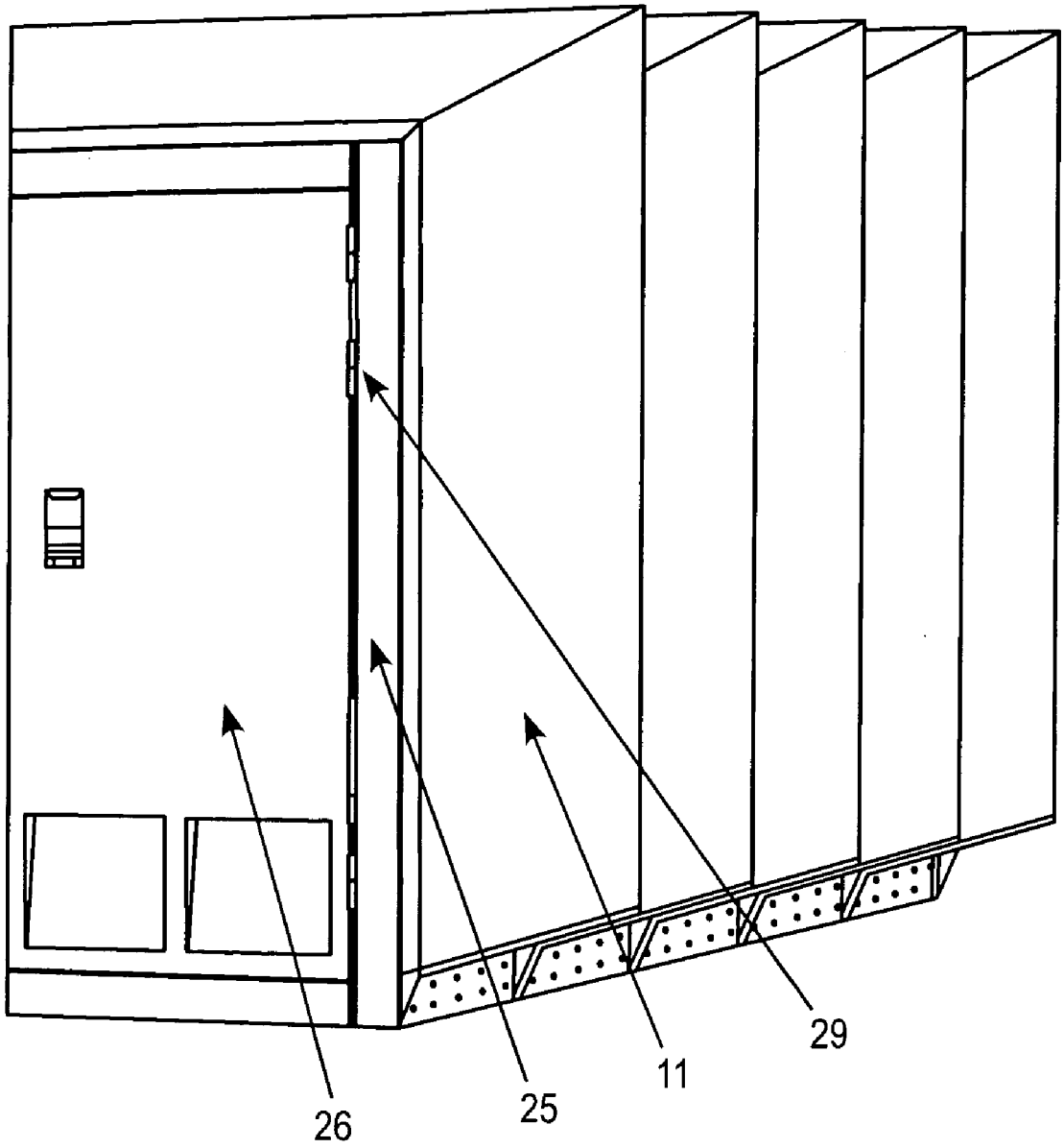
FIG. 6 is a drawing of the side wall and part of the door frame from the back of the CSS.

The door assembly 25 is shown from the outside in the drawing FIG. 6 and, furthermore, illustrated in FIG. 2*a* and FIG. 2*b*, is attached to the overall enclosure structure of modules 10 by similar mechanical components as used between the modules. A frame of top profile, bottom profile and left/right vertical profiles forms the door assembly 25, and includes rabbet profiles for proper door closing. Gaskets can be further attached to the rabbet profile of the door frame for improved insulation. The door assembly 25 also holds hinges 29 and doorstop mechanism; doors are mounted on the hinges and bolted to the doorstop mechanism. When doors 26, 27 are mounted on the door assembly 25 and closed, no access for the mounting rivets or screws at the hinges 29 is available, thus preventing unauthorized personnel to demount doors 26, 27 by detaching the hinges 29.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. An electrical transformer station suitable to accommodate an electrical transformer and comprising a foundation and a housing on top of the foundation, wherein said housing comprises a plurality of identical modules assembled in a row along a longitudinal axis of the housing, each module of the plurality of identical modules having two side walls and a roof section connecting the two side walls;

wherein each of the two side walls and the roof section are each provided as a substantially identical shaped profile, and wherein the substantially identical shaped profile has a cross section comprising:

a straight section;

a V-shaped profile extending from one end of the straight section with a sharp angle (w) between the V-shaped profile and the straight section, the V-shaped profile ending in a first L-formed profile; and a second L-formed profile extending from an opposite end of the straight section.

2. The electrical transformer station according to claim 1, wherein the electricity transformer station is a compact secondary substation.

3. The electrical transformer station according to claim 1, wherein the plurality of identical modules are fastened to each other by means of a single type of screws or rivets, where all the screws or the rivets have the same dimension.

4. The electrical transformer station according to claim 1, wherein each module has substantially identical assembly flanges on both ends of the two side walls for mutual assembly to an adjacent module of the plurality of identical modules.

5. The electrical transformer station according to claim 4, wherein the plurality of identical modules comprise a first module and a second module, wherein the substantially identical assembly flanges are interconnected by means of a U-formed profile with a first leg and a second leg forming the U-formed profile, and wherein the first leg is connected to the first module and the second leg is connected to the second module.

6. The electrical transformer station according to claim 1, wherein each of the two side walls and the roof section have an angle v larger than zero with respect to the longitudinal axis of the housing.

7. The electrical transformer station according to claim 6, wherein the angle v is between 10° and 45°.

8. The electrical transformer station according to claim 1, further comprising: a door part with an access door and a surrounding door frame, the door frame being mounted to an end of the assembled plurality of identical modules.

9. The electrical transformer station according to clam 1, wherein the plurality of identical modules comprise a first module, a second module, and a third module, the second module and the third module are identical to the first module, wherein the first module has a first flange section with a first flange for connection with the second module, and has a second flange section with a second flange for connection with the third module, and wherein the two side walls and the roof section connect the first flange section and the second flange section, the first flange section having outer dimensions (d2) larger than outer dimensions (d1) of the second flange section due to the two side walls and the roof section being non-parallel with the longitudinal axis of the housing.

10. The electrical transformer station according to claim 9, wherein the first flange section has an upper wall part connecting the roof section with the first flange.

11. The electrical transformer station according to claim 10, wherein the upper wall part has outlet openings for ventilation.

12. The electrical transformer station according to claim 11, wherein the each module has a bottom wall extending a distance from each of the two side walls, the bottom wall being provided with inlet openings for ventilation.

13. The electrical transformer station according to claim 12, wherein the ratio between a cross section area of the inlet openings and a cross section area of the outlet openings is substantially 4:5.

14. An electrical transformer station suitable to accommodate an electrical transformer and comprising a foundation and a housing on top of the foundation, wherein said housing comprises a plurality of identical modules assembled in a row along a longitudinal axis of the housing, each module of the plurality of identical modules having two side walls and a roof section connecting the two side walls;

wherein the each module have substantially identical assembly flanges on both ends of the two side walls for mutual assembly to an adjacent module of the plurality of identical modules, wherein the substantially identical assembly flanges are interconnected by means of a U-formed profile with a first leg and a second leg forming the U-form, wherein the plurality of identical modules comprise a first module and a second module, and wherein the first leg is connected to the first module and the second leg is connected to the second module.

15. The electrical transformer station according to claim 14, wherein the electricity transformer station is a compact secondary substation.

16. The electrical transformer station according to claim 14, wherein the plurality of identical modules are fastened to each other by means of a single type of screws or rivets, where all the screws or the rivets have the same dimension.

17. An electrical transformer station suitable to accommodate an electrical transformer and comprising a foundation and a housing on top of the foundation, wherein said housing comprises a plurality of identical modules assembled in a row along a longitudinal axis of the housing, each module of the plurality of identical modules having two side walls and a roof section connecting the two side walls;

wherein the plurality of identical modules comprise a first module, a second module, and a third module, the second module and the third module are identical to the first module, wherein the first module has a first flange section with a first flange for connection with the second module, and has a second flange section with a second flange for connection with the third module, and wherein the two side walls and the roof section connect the first flange section and the second flange section, the first flange section having outer dimensions (d2) larger than outer dimensions (d1) of the second flange section due to the two side walls and the roof section being non-parallel with the longitudinal axis of the housing.

18. The electrical transformer station according to claim 17, wherein the first flange section has an upper wall part connecting the roof section with the first flange.

19. The electrical transformer station according to claim 17, wherein the upper wall part has outlet openings for ventilation.

20. The electrical transformer station according to claim 17, wherein the module has a bottom wall extending a distance from each of the two side walls, the bottom wall being provided with inlet openings for ventilation.

* * * * *